United States Patent [19]

Miller, Jr.

[11] Patent Number: 4,950,170

[45] Date of Patent: Aug. 21, 1990

[54] MINIMAL SPACE PRINTED CIRCUIT BOARD AND ELECTRICAL CONNECTOR SYSTEM

[75] Inventor: Grady A. Miller, Jr., Grand Prairie, Tex.

[73] Assignee: LTV Aerospace & Defense Company, Grand Prairie, Tex.

[21] Appl. No.: 210,751

[22] Filed: Jun. 23, 1988

[51] Int. Cl.[5] ..... H01R 9/09

[52] U.S. Cl. ..... 439/74; 439/82; 439/92; 439/499; 439/629

[58] Field of Search ..... 439/74–76, 439/82, 92, 94, 106, 44, 45, 493, 271, 608, 825–827, 260, 629

[56] References Cited

U.S. PATENT DOCUMENTS 3,196,318 7/1965 Richardson ..... 439/45
4,030,792 6/1977 Fuerot ..... 439/629
4,533,200 8/1985 Wilson ..... 439/499
4,797,113 1/1989 Lambert ..... 439/74

FOREIGN PATENT DOCUMENTS 2756149 6/1979 Fed. Rep. of Germany ..... 439/74

*Primary Examiner*—P. Austin Bradley
*Attorney, Agent, or Firm*—Arnold, White & Durkee

[57] ABSTRACT

A system of printed circuit boards is interconnected by using connectors having electrically conductive assemblies that include both pins and sockets. The pins of the assemblies of one connector pass through apertures in the printed circuit boards and engage the sockets of assemblies of another connector on the other side of the printed circuit board. In this manner any number of printed circuit boards may be interconnected to form continuous electrical circuits from one printed circuit board to the next and also provide a mechanical means of holding the system of printed circuit boards together.

14 Claims, 3 Drawing Sheets

MINIMAL SPACE PRINTED CIRCUIT BOARD AND ELECTRICAL CONNECTOR SYSTEM

BACKGROUND AND SUMMARY OF THE INVENTION

The present invention relates broadly to electrical circuit boards, and more particularly to a system for interconnecting such boards. The invention more especially relates to a system wherein the pins in one connector on one side of a circuit board extend through electrically conductive apertures in the circuit board to a socket in a connector on the other side of the circuit board. The resulting assembly of circuit boards and connectors may resemble a "sandwich".

A common problem in interconnecting printed circuit boards is the space required for making the necessary connections. The problem is particularly acute in applications such as guided missiles where equipment must generally be as compact as possible. Unfortunately, the connectors currently used in such applications occupy considerable space between the circuit boards they serve to interconnect. More efficient use of the space in equipment using circuit boards results in smaller equipment which is often critical in applications such as guided missiles. Consequently, the art has sought to reduce the amount of wasted space. It is accordingly a general feature of the present invention to provide a system of interconnecting circuit boards which reduces the space presently required between circuit boards.

The use of pins on connectors which pass through apertures on printed circuit boards is known. For example, U.S. Pat. No. 4,133,592 teaches the use of such connectors to increase the efficiency of connections between printed circuit boards.

Although the use of such connectors is known, there has been no suggestion for using such connectors both to provide the mechanical force necessary to hold the system together and also to provide connections for power and ground circuits. Further, there has been no suggestions for using a split-tip pin which provides a better electrical contact based on (1) the mechanical force it exerts to maintain contact, and (2) its greater surface area of contact.

The invention reduces the wasted space in parallel arrays of printed circuit boards by decreasing the space required for interconnecting the circuit boards. Further, it provides for electrical signal, power, and ground connections between the parallel circuit boards and also provides a mechanical connection using a connector device which is separate from the circuit boards.

The present invention in a broad aspect comprises a system of interconnected printed circuit boards wherein multiple bi-polar assemblies are employed to interconnect two connectors on opposite sides of a printed circuit board with each other and also with the circuit board. In its simplest form an individual assembly comprises an elongated electrical conductor which has a pin at one end and a socket at the other. The assembly is mounted or embedded in a suitable connector board or the like such that the mouth of the socket is generally flush with one surface or side of the connector board, and such that the pin extends beyond the opposite side or surface of the connector board a distance sufficient to pass through an aperture in a circuit board and enter the socket end of a similar assembly in a second connector board. The aperture in the circuit board is, itself, electrically conducting and serves to connect the pin electrically with circuits or the like on the circuit board. At either end of such a system a flexible ribbon conductor with the appropriate pins or sockets connects to the connector for electric signal transmission.

The foregoing assembly is generally preferred for use in transmitting signals between circuit boards and connectors. A modified form of that assembly is preferably employed to make both a mechanical connection and also an electrical connection for transmitting electrical power. The modified form is basically larger and sturdier than the signal form, and includes a split-tip pin.

BRIEF DESCRIPTION OF DRAWINGS

The above-noted and other aspects of the present invention will become more apparent from a description of the preferred embodiment when read in conjunction with the accompanying drawings.

The drawings illustrate the preferred embodiment of the invention, wherein like members bear like reference numerals and wherein.

DESCRIPTION OF THE PREFERRED EMBODIMENT

Figure 1:
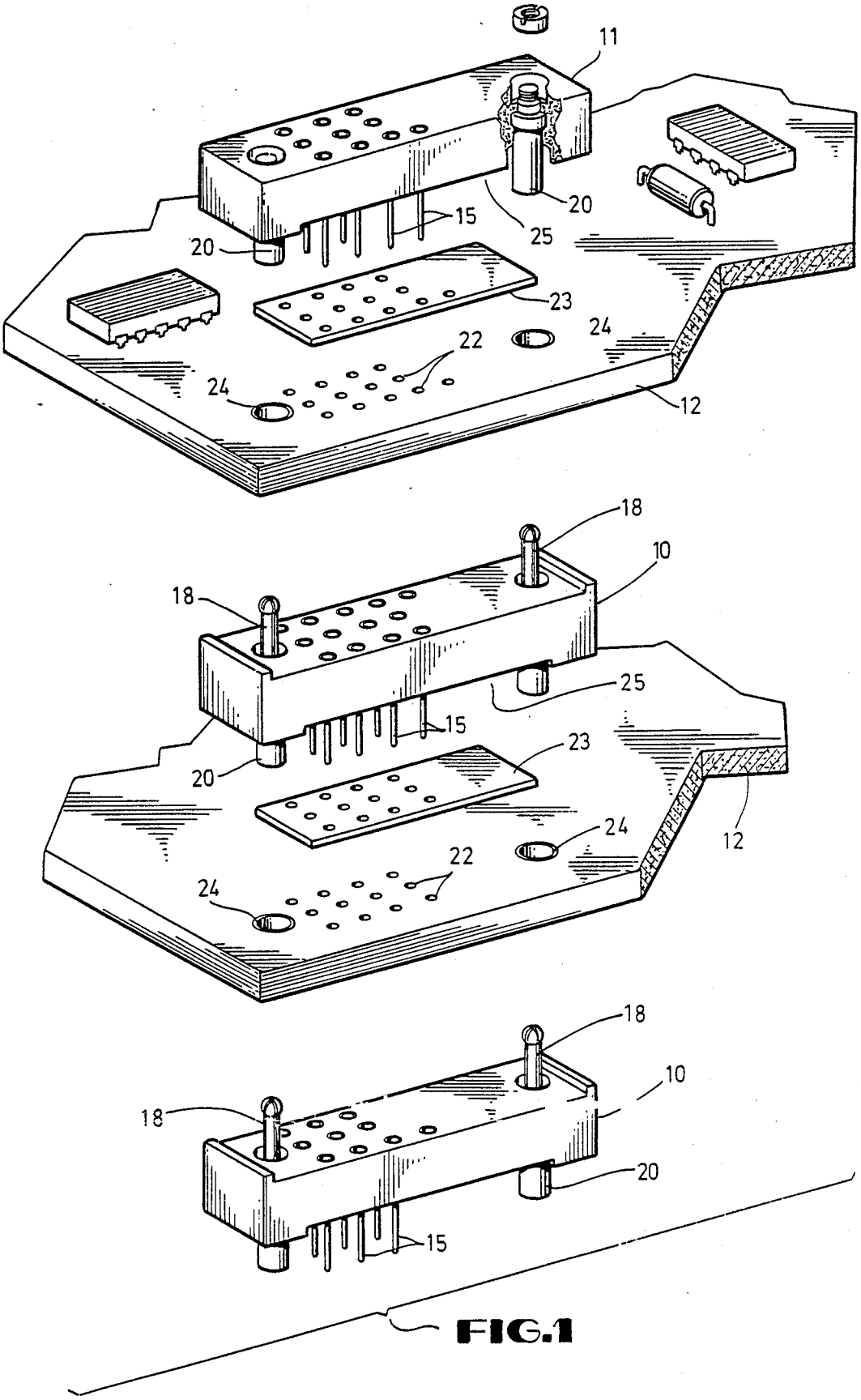
FIG. 1 illustrates an exploded view of a system of printed circuit boards and connectors.

FIG. 1 illustrates connectors 10 built according to the present invention and printed circuit boards 12 in which the connectors plug. Multiple boards 12 connected together comprise a circuit board system. An end connector 11 is used at one end of the system.

Figure 2:
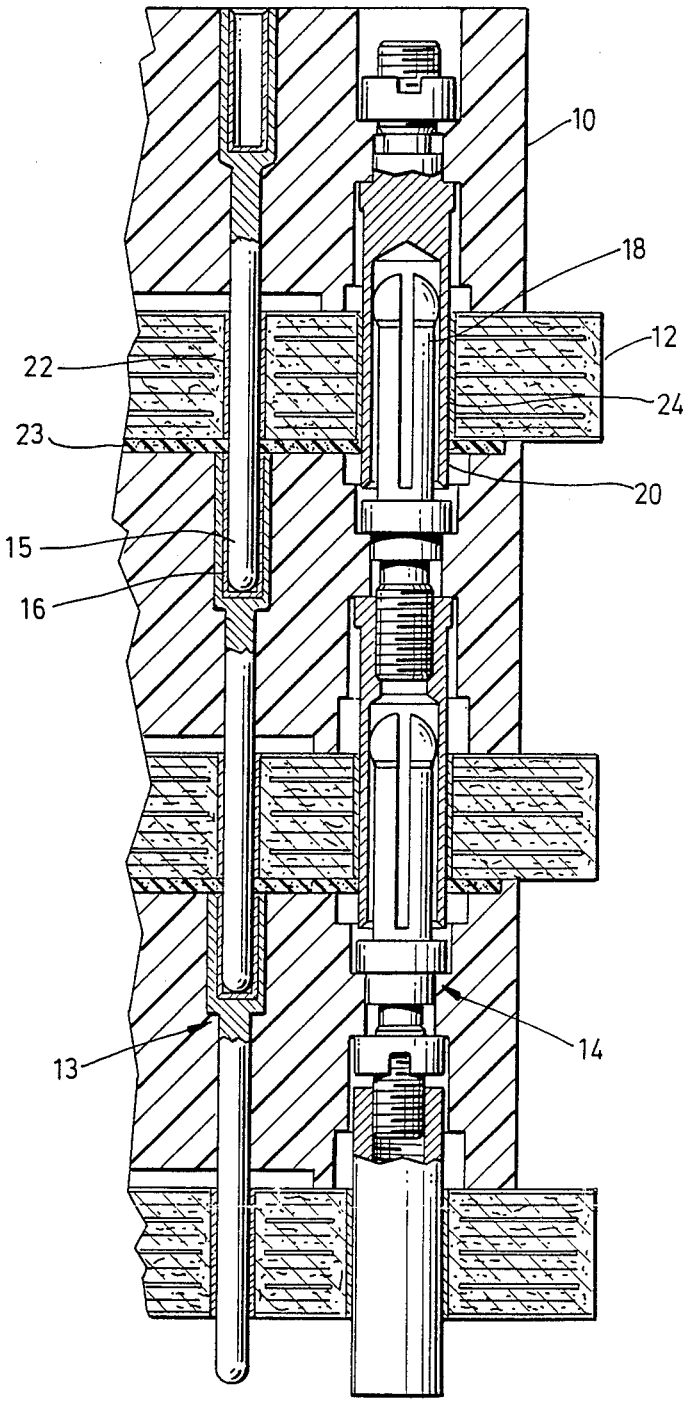
FIG. 2 illustrates a detailed view of signal and power assemblies.

Referring to FIG. 2, each connector 10 includes multiple signal assemblies 13 and multiple power assemblies 14. Each signal assembly 13 has a signal pin 15 and a signal socket 16 for carrying electrical signals. Each power assembly 14 has a power pin 18 and a power socket 20 for providing both a mechanical connection and for electrical power and ground. Each connector 10 is made of a dielectric material except that the outer surface is plated with an electrically conductive material.

Referring to both FIG. 1 and FIG. 2, each printed circuit board 12 has signal apertures 22 extending through the board which receive the signal assemblies 13, and power apertures 24 extending through the board which receive the power assemblies 14. The apertures 22 and 24 need not have circular cross-sections. Rather, square, hexagonal, or other cross-sections may be used. The apertures 22 and 24 in one board 12 align with the apertures 22 and 24 respectively in another board 12. A closed cell silicone environmental gasket 23 separates the pin side 25 of the connector from the printed circuit board, to keep moisture out of the apertures 22 and 24.

Each signal pin 15 of a first signal assembly 13 extends through its respective circuit board aperture 22 into the socket 16 of a second signal assembly 13 in the connector 10 on the opposite side of the circuit board 12. Each signal socket 16 is flush with the edge of the connector 10. The signal assembly 13 provides a continuous electrical path from one connector to another connector. Signals from the signal pins 14 travel to the printed circuit boards through the apertures 22 which are plated with electrically conductive material, and communicate with the appropriate signal circuits on the printed circuit board.

Each signal pin 15 has a circular cross-section with a rounded tip and is made of an electrically conductive material. The outside diameter of the signal pin 15 is substantially the same as the inside diameter of the signal sockets 16 which receive the signal pins 15, and is also substantially the same as the inside diameter of the apertures 22. Only a small amount of mechanical force is required to insert the signal pins 15 through the circuit board apertures 22 into the socket 16 in the connector 10 on the other side of the circuit board.

The power pin 18 of a first power assembly 14 extends through its corresponding circuit board aperture 24 into the socket 20 of a second power assembly 14 in the connector 10 on the other side of the circuit board.

Figure 3:
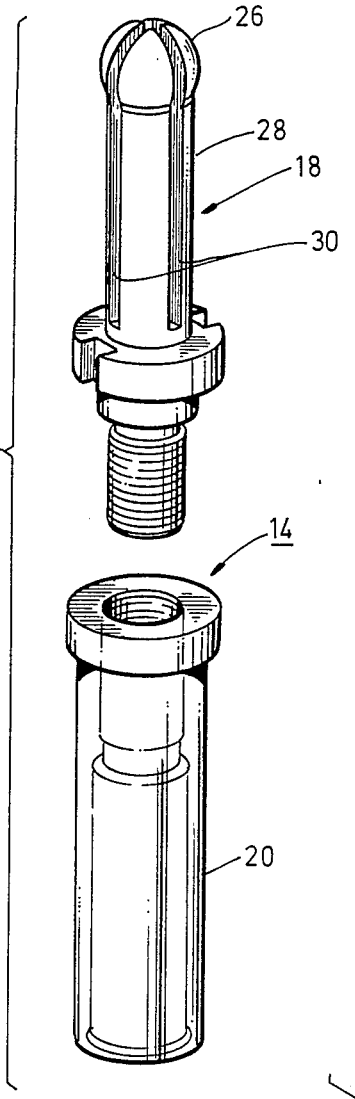
FIG. 3 illustrates a power assembly.

FIG. 3 illustrates a perspective view of the power pin 18, having a tip 26 and a shaft 28. The tip 26 is a hemisphere of slightly larger diameter than the shaft 28. The tip 26 and the shaft 28 are split into four parts of substantially equal size by two slots 30 at 90° angles to each other. The pin is made of an electrically conductive material such as heat-treated BeCu Alloy 123 with a nickel-plated finish.

The tip 26 without radial compression has a slightly larger diameter than the socket 20. The two slots 30 in the power pin 18 allow the pin 18 of a first power assembly 14 to be radially compressed in the socket 20 of a second power assembly. The compression of the power pin 18 provides the mechanical force to keep the pin 18 in tight contact with the socket 20 in spite of vibration or other mechanical shocks to the system. The power assembly 14 provides a continuous electrical path from one connector to another connector. The power and ground circuits of the printed circuit boards are communicated to the power pins 18 through the apertures 24 which are plated with electrically conductive material and communicate with the appropriate power and ground circuits on the printed circuit board.

Figure 4:
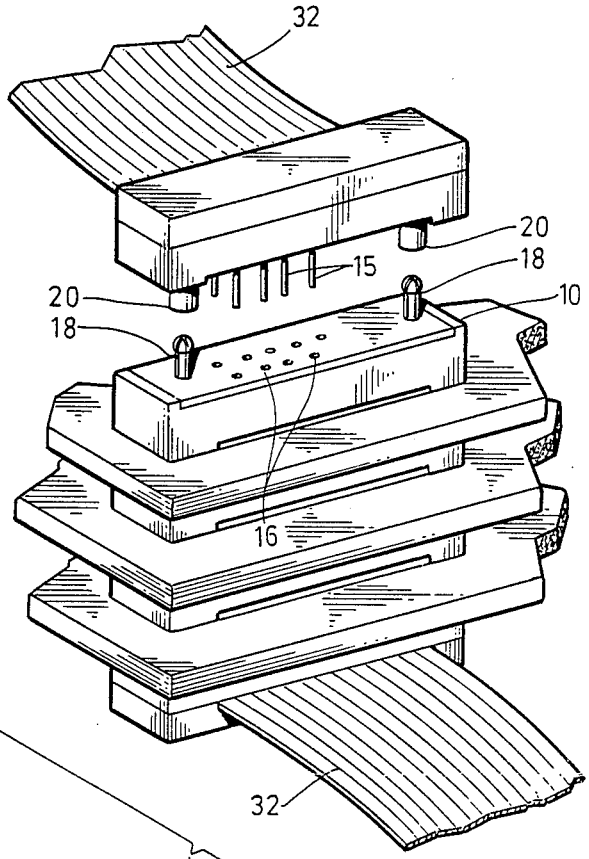
FIG. 4 illustrates a flexible ribbon conductor attached to a connector.

Referring now to FIG. 4, a connector 10 is depicted connected to a flexible ribbon conductor 32. The flexible ribbon conductor 32 connects to the connector 10 at either end of a system of circuit boards. The signal pins 15 fit into sockets in the flexible ribbon conductor 32 sized to match the signal pins 15. Likewise, the socket 20 receives a pin from the flexible ribbon conductor and the power pin 18 fits into a socket in the flexible ribbon conductor. Although not shown, a flexible ribbon conductor 32 has signal pins 15 which fit into the signal sockets 16 of a connector 10.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A connector for interconnecting printed circuit boards comprising:

a. a connector body having opposite surfaces configured to fit against the surfaces of printed circuit boards, the connector comprising a dielectric material covered with a coating of an electrically conductive material;

b. an electrical connecting element mounted within the connector body with a pin-type connecting end at one end and a socket-type connecting end at the other end sized to receive such a pin-type connecting end in a sliding electrical contact; and c. at least one of the two connecting ends projecting beyond the connector body a distance sufficient to pass through opposite surfaces of a printed circuit board and to make a sliding electrical contact with the opposite type connecting end of another such connecting element in another connector body with each opposite surface of the circuit board fitting against a surface of a separate one of the two connector bodies.

2. The connector of claim 1 wherein the electrical connecting element mechanically connects the printed circuit boards through which it extends.

3. The connector of claim 1 wherein the pin-type connecting end is a solid cylinder having a tip divided into sections.

4. The connector of claim 3 wherein the tip without radial compression by a socket-type connecting end has an outside diameter greater than the inside diameter of the socket-type connecting end.

5. A connector for interconnecting first and second printed circuit boards having first and second circuits, the second circuits carrying higher current densities than the first circuits, the connector comprising:

a. a connector body;

b. a first connector assembly mounted within the connector body, the first connector adapted for connecting circuits on a first printed circuit board with the first circuits on a second printed circuit board; and c. a second connector assembly mounted within the connector body, the second connector adapted for connecting the second circuits on the first printed circuit board with second circuits on the second printed circuit board.

6. The connector of claim 5 wherein the connector body is made of a dielectric material covered with an electrically conductive material.

7. The connector of claim 5 wherein the first and second connector assemblies each have a pin at one end and a socket at the other end sized to receive such a pin in a sliding electrical contact.

8. The connector or claim 7 wherein the pin of the second connector assembly has a larger diameter than the pin of the first connector assembly.

9. The connector of claim 8 wherein the pin of the second connector assembly has a divided tip whose separate sections are joined at a distance from the tip.

10. A connector for interconnecting printed circuit boards comprising:

(a) a connector body;

(b) a first group of electrical connecting elements mounted within the connector body with a pin-type connecting end at one end and a socket-type connecting end at the other end sized to receive such a pin-type connecting end in a sliding electrical contact;

(c) a second group of electrical connecting elements mounted within the connector body with a pin-type connecting end at one end and a socket-type connecting end at the other end, the pin-type connecting end having a tip divided into sections and an outside diameter greater than the inside diameter of the socket-type connecting end, the socket-type connecting end receiving such a pin-type connecting end and maintaining the pin-type connecting end in a state of radial compression;

(d) at least one of the two connecting ends of each electrical connecting element of the first group projecting beyond the connector body a distance sufficient to pass through opposite surfaces of a printed circuit board and to make a sliding electrical contact with the opposite type connecting end of another such connecting element in another connector body;

(e) at least one of the two connecting ends of each electrical connecting element of the second group projecting beyond the connector body a distance sufficient to pass through opposite surfaces of a printed circuit board and to make an engaging electrical and mechanical contact with the opposite type connecting end of another such connecting element in another connector body;

wherein each opposite surface of the circuit board fits against a surface of a separate one of the two connector bodies; and wherein one of the two groups of electrical connecting elements supplies electrical signals to the printed circuit boards and the other of the two groups of electrical connecting elements supplies electrical power and electrical ground to the printed circuit boards.

11. The connector of claim 10 wherein the connector body is made of a dielectric material and is covered with an electrically conductive material.

12. A connector for interconnecting printed circuit boards comprising:

(a) a connector body;

(b) a plurality of signal assemblies mounted within the connector body, said signal assemblies comprising a signal pin at one end of each assembly and a signal socket at the opposite end, said signal socket having an inside diameter sized to slidably engage a signal pin thereby to establish an electrical contact;

(c) a plurality of power assemblies mounted within the connector body, said power assemblies comprising a power pin at one end of each assembly and a power socket at the opposite end, said power socket having an inside diameter sized to slidably engage a power pin thereby to establish both an electrical contact and a mechanical connection;

wherein said signal pins protrude beyond the connector body a distance sufficient to pass through opposite surfaces of a printed circuit board to make a sliding electrical contact with a signal socket of another such signal assembly in another connector body;

the power pin end of each power assembly comprises a tip divided into two or more sections, said tip having an outside diameter greater than the inside diameter of the power sockets; and wherein said power pins protrude beyond the connector body a distance sufficient to pass through opposite surfaces of a printed circuit board to make a sliding electrical contact and mechanical connection with a power socket of another such power assembly in another connector body.

13. The connector of claim 12 wherein said power sockets protrude beyond the connector body.

14. The connector of claim 13 wherein the connector body is made of a dielectric material and is covered with an electrically conductive material.

* * * * *